United States Patent [19]

Bartoo

[11] 4,118,886

[45] Oct. 10, 1978

[54] TOY ELEVATOR SAFETY OVERRIDE DRIVE MECHANISM

[75] Inventor: George O. Bartoo, West Falls, N.Y.

[73] Assignee: The Quaker Oats Company, Chicago, Ill.

[21] Appl. No.: 764,568

[22] Filed: Feb. 1, 1977

[51] Int. Cl.[2] ..... A63H 33/30

[52] U.S. Cl. ..... 46/1 R; 46/39; 46/12

[58] Field of Search ..... 64/29; 46/1 R, 12, 202, 46/206, 39

[56] References Cited

U.S. PATENT DOCUMENTS 618,810 1/1899 Wood ..... 46/12

2,688,857 9/1954 Jones ..... 64/29

3,483,653 12/1969 Genin ..... 46/12

*Primary Examiner*—Louis G. Mancene

*Assistant Examiner*—Robert F. Cutting

*Attorney, Agent, or Firm*—Cumpston & Shaw

[57] ABSTRACT

A rotatable drive mechanism for driving a driven mechanism of a toy such as a reciprocally movable elevator or the like. The rotatable drive mechanism drives the driven mechanism in either direction of rotation. The drive mechanism has a safety override feature that allows the drive mechanism to continue to drive when the driven mechanism is held or stopped by an obstruction or the like without damaging the drive and/or driven mechanisms.

2 Claims, 5 Drawing Figures

TOY ELEVATOR SAFETY OVERRIDE DRIVE MECHANISM

BACKGROUND OF THE INVENTION

1. Field of the Invention

This invention relates generally to drive mechanisms for toys, and more specifically to a safety override rotatable drive mechanism for a toy elevator or the like.

2. Description of the Prior Art

It is known in the prior art to provide toys having drive and driven mechanisms directed coupled together. To prevent the drive and/or driven mechanisms from breaking in the event the driven mechanism strikes an obstruction, it is necessary to build the toy mechanisms out of a plastic or metal material that is sufficiently strong to prevent breakage in the event the child attempts to continue to drive the drive mechanism. This necessitates increasing the size of the parts and utilizing more costly materials of greater strength. This results in a bulkier and more costly toy.

SUMMARY OF THE INVENTION

In accordance with a preferred embodiment of the invention, a safety override rotatable drive mechanism for driving a driven mechanism of a toy such as an elevator or the like is disclosed. The drive mechanism or drive means includes a rotatable drive member having an axis and a drive surface having end portions lying in a plane substantially perpendicular to a radius of the drive members extending through a midpoint of the drive surface. The midpoint is radially spaced a first distance from the axis. The end portions are radially spaced from the axis a second distance greater than the first distance. The driven mechanism or driven means includes a rotatable member driven by the drive member and coupled to a predetermined load such as an elevator. The driven member has an axis coincident with the axis of the drive member. The driven member further has a resilient flexible driven surface which in its normal unflexed condition lies in a second plane substantially perpendicular to a radius of the driven member extending through the center of the driven surface. The center is radially spaced from the axis a distance substantially equal to the first distance. Accordingly, when the drive and driven surfaces are arranged in contiguous relation, the drive surface will drive the driven surface and load upon rotation of the drive member. When the load on the driven member exceeds the predetermined load, the end portions of the drive member flex the resilient driven surface radially outwardly a distance substantially equal to the second distance allowing the end portions to override the driven surface. This normally occurs when the driven member is held or strikes an obstruction or the like blocking further movement of the driven member.

In another aspect of the invention, the drive member comprises at least one drive surface, and the resilient driven surface comprises a flexible leaf spring.

In a more specific aspect of the invention, the drive mechanism comprises a crank to which the drive member is rigidly secured and rotated upon manual rotation of the crank. The driven mechanism comprises an elevator and a gear train coupling the driven member to the elevator. The elevator is guided for reciprocal movement between at least two floors upon rotation of the crank in either direction.

The invention and its advantages will become more apparent from the detailed description of the preferred embodiment presented below.

BRIEF DESCRIPTION OF THE DRAWING

In the detailed description of the preferred embodiment of the invention presented below, reference is made to the accompanying drawing, in which.

DESCRIPTION OF THE PREFERRED EMBODIMENT

Figure 1:
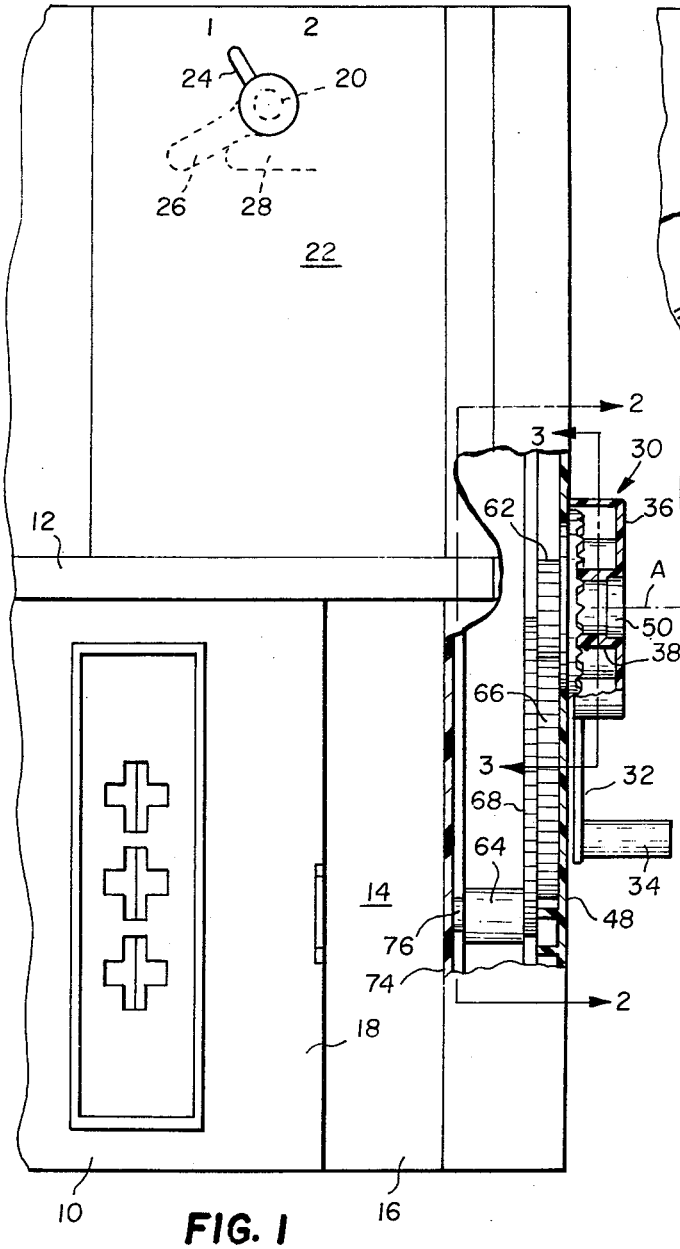
FIG. 1 is a segmental side elevational view with portions broken away of a preferred embodiment of the safety override drive toy mechanism of this invention incorporated in a toy building for reciprocally moving an elevator.

With reference to FIG. 1, a preferred embodiment of the safety override drive mechanism for a toy of this invention is incorporated in a toy building having first and second floors 10, 12 respectively and an elevator 14 movable therebetween. The elevator 14 has a front opening 16 at first floor level 10 which can be closed by a sliding door 18. The elevator 14 further has a side opening, not shown, permitting access onto the elevator from second floor 12.

The elevator 14 has a floor indicating device (FIG. 1) comprising a stub shaft 20 journaled for rotation in a wall 22 on the second floor. The shaft 20 has a pointer 24 secured to one end on the outside of wall 22 and a follower arm 26 secured to the opposite end on the inner side of the wall. When elevator 14 is on first floor 10 as indicated in FIG. 1, the weight of follower arm 26 pivots the indicating device against a stop 28 in which pointer 24 is pointing to the numeral 1. When elevator 14 is moved to second floor 12, the top of the elevator engages follower arm 26 and pivots arm 26 and shaft 20 causing pointer 24 to point to the numeral 2.

With reference to FIGS. 1–5, a safety override rotatable drive mechanism comprising drive and driven means for moving the elevator between the first and second floors 10, 12 will now be described. The drive means comprises a rotatable drive member or crank 30 having an arm 32, a lateral extending handle 34 at one end of the arm, and a circular housing 36 integral with the other end of the arm. The housing 36 comprises an axially extending, substantially square-shaped cam drive member 38 having an axis A and an axial opening extending therethrough. The drive member 38 has drive surfaces 40 (FIGS. 3 and 5) having end portions 42 lying in a plane substantially perpendicular to a radius of drive member 38 extending through a midpoint of drive surface 40. The midpoint is radially spaced a distance "*a*" from axis A. The end portions 42 are radially spaced from axis A a distance "*b*" which is greater than "*a*".

Figure 3:
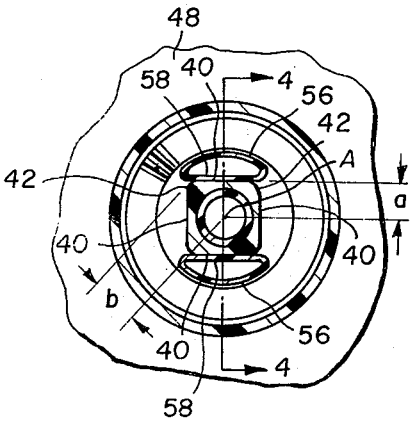
FIG. 3 is a sectional view taken substantially along line 3—3 of FIG. 1.
Figure 4:
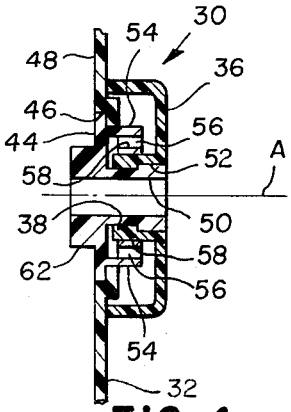
FIG. 4 is a sectional view taken substantially along line 4—4 of FIG. 3.
Figure 5:
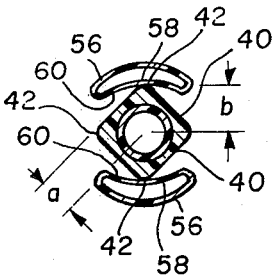
FIG. 5 is a view similar to FIG. 3 with portions omitted for clarity and showing the safety override feature in operation.

The driven means as best seen in FIGS. 3–5 comprises a driven member including a disk 44 rotatable in an opening 46 in a wall 48 of the building. The disk 44 has a spindle 50 extending along axis A and pressed into the axial opening in drive cam member 38 for rotatably supporting crank 30. A detent 52 comprising a rib on spindle 50 and a complementary groove in crank housing 36 retains the crank on the spindles.

The disk 44 further has a pair of diametrically opposed, axially extending ribs 54 (FIG. 4) having a flexible resilient endless loop 56 secured to each end thereof. Each loop 56 has a leaf spring portion 58 having a driven surface 60 which in its normal unflexed condition lies in a plane substantially perpendicular to a radius of disk 44 extending through the center of driven surface 60. The center is radially spaced from axis A a distance substantially equal to distance "*a*". The parallel leaf spring portions 60 on disk 44 are spaced apart as seen in FIG. 3 a distance equal to or slightly greater than the distance "2*a*" between opposed drive surfaces 40 on drive member 38. Accordingly, when the drive and driven surfaces are arranged in contiguous relation, rotation of crank 30 and cam drive member 38 will impart rotation to disk 44.

Figure 2:
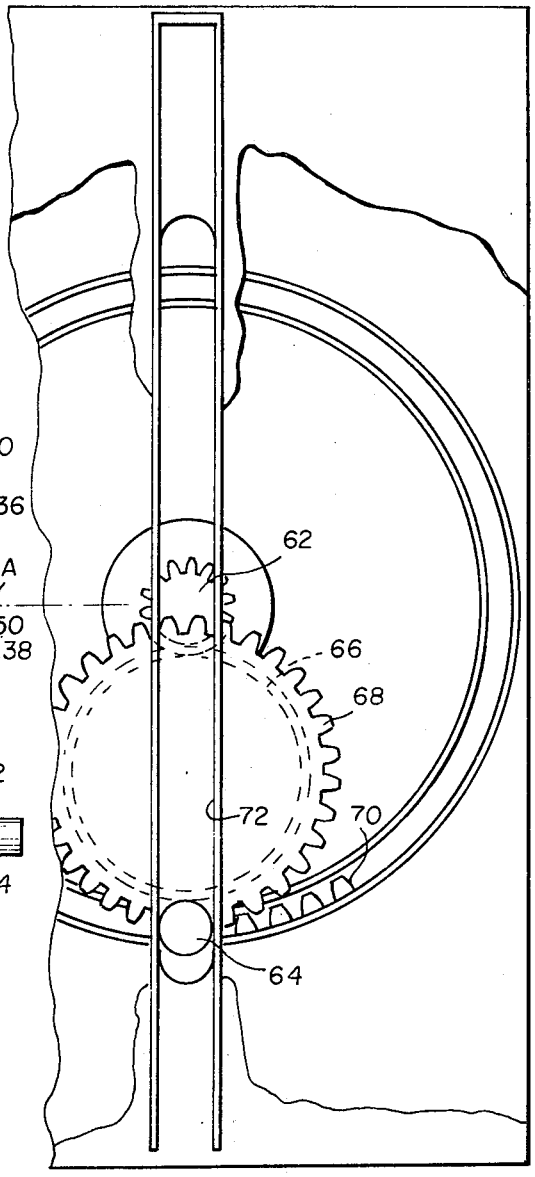
FIG. 2 is a section view taken substantially along line 2—2 of FIG. 1 with portions broken away showing a part of the gear train.

With reference to FIGS. 1, 2 and 4, disk 44 has an axially extending pinion 62 on its other side for reciprocally moving a tubular coupling 64 through a planetary gear train. The gear train comprises a ring gear 66 in mating engagement with pinion 62. A ring gear 68 laterally offset but integral with gear 66 is provided in mating engagement with a fixed annular gear 70 integral with a wall of the building. The tubular coupling 64 is secured to the face of gear 68 on its pitch circle and extends laterally therefrom into a slot 72 in the housing wall which guides tubular coupling 64 for reciprocal movement. A wall 74 of elevator 14 has a laterally extending spindle 76 which nests in tubular coupling 64. Accordingly, rotation of crank 30 in either direction of rotation rotatably driven disk 44 and pinion 62 which through the planetary gear train and tubular coupling 64 reciprocally moves elevator 14 between the first and second floors 10, 12 respectively.

With reference to FIG. 5, the safety override feature of this invention is achieved by the aforementioned leaf springs 58 of flexible loops 56. The leaf springs 58 in their normal position can transmit sufficient torque from drive cam member 38 to drive elevator 14 and any reasonable load placed therein without slipping. However, if the load exceeds a predetermined load by, for example, elevator 14 being manually held or striking an obstruction preventing movement of the elevator, loops 56 and/or leaf springs 58 will be deflected radially outwardly by end portions 42 of drive member 38, which as indicated earlier extend radially outwardly a distance "*b*" which is greater than distance "*a*". Consequently, crank 30 and drive member 38 can be rotated causing end portions 42 of drive member 38 to deflect leaf spring portions 58 and slide by without driving disk 44 so that no part of the drive and driven means will be damaged or broken. When the obstruction is removed, drive crank 30 and cam member 38 will once again rotatably drive disk 44 via the drive engagement between drive surfaces 40 and leaf spring driven surfaces 60 as described heretofore. By suitably designing loops 56 and springs 58 with relation to material and dimensions, it is possible to control the amount of torque capable of being transmitted to the load. Any torque in excess thereto will merely deflect the loops and/or springs and will not be transmitted to the load.

The invention has been described in detail with particular reference to a preferred embodiment, but it will be understood that variations and modifications can be effected within the spirit and scope of the invention as described hereinabove.

What is claimed is:

1. A toy elevator safety override drive mechanism for preventing damage to the drive mechanism comprising:

first means including a rotatable drive member having a first axis and a drive surface having end portions lying in a first plane substantially perpendicular to a radius of said drive member extending through a midpoint of said drive surface, said midpoint being radially spaced a first distance from said first axis, and said end portions being radially spaced a second distance greater than said first distance from said first axis;

second means including a rotatable member driven by said drive member and coupled to an elevator mechanism, said driven member having a second axis coincident with said first axis and comprising a resilient flexible loop having a resilient leaf spring portion which in its normal unflexed condition lies in a second plane substantially perpendicular to a radius of said driven member extending through a center of said leaf spring portion, said center being radially spaced from said second axis a distance substantially equal to said first distance whereupon said drive surface when arranged contiguous to said leaf spring portion is substantially parallel thereto and engages and drives said leaf spring portion and elevator mechanism upon rotation of said drive member, said end portions of said drive member further adapted when said elevator mechanism is jammed or blocked to flex said leaf spring portion radially outwardly from its normal condition a distance substantially equal to said second distance to allow said end portions to override said driven surface whereby damage to said drive mechanism is prevented.

2. The toy elevator safety override drive mechanism of claim 1 wherein said first means comprises a crank to which said drive member is rigidly secured and rotated upon manual rotation of said crank, said drive member comprises a plurality of angularly spaced drive surfaces, said driven member comprises a rotatable disk perpendicular to said first axis and having a pair of opposed laterally extending resilient flexible loops, each loop having a resilient leaf spring portion in normal engagement with a drive surface, and said second means further comprises a planetary gear train having a pinion secured to said driven member and a plurality of intermeshed gears, one of which is driven by said pinion, and another which is coupled to said elevator mechanism and guided for reciprocal movement for moving said elevator mechanism up and down upon rotation of said crank.

* * * * *